US006408453B1

(12) United States Patent
Song et al.

(10) Patent No.: US 6,408,453 B1
(45) Date of Patent: Jun. 25, 2002

(54) INFLATABLE SWIMMING POOL ASSEMBLY

(75) Inventors: Rong-Jyh Song; Tsung-Ping Yen, both of Taipei (TW)

(73) Assignee: Aqua-Marine International Inc., Taipei (TW)

( * ) Notice: Subject to any disclaimer, the term of this patent is extended or adjusted under 35 U.S.C. 154(b) by 0 days.

(21) Appl. No.: 09/865,789

(22) Filed: May 25, 2001

(51) Int. Cl.[7] ..... E04H 4/00; E04H 4/10
(52) U.S. Cl. ..... 4/506; 4/499
(58) Field of Search ..... 4/503, 506, 498, 4/499; 220/375, 324

(56) References Cited

U.S. PATENT DOCUMENTS 3,608,099 A * 9/1971 Wall ..... 4/503
3,683,427 A * 8/1972 Burkholz et al. ..... 4/503
3,980,202 A * 9/1976 Monyak et al. ..... 220/375
5,144,704 A * 9/1992 Genzel et al. ..... 4/499
5,924,144 A * 7/1999 Peterson ..... 4/506
6,209,149 B1 * 4/2001 Song et al. ..... 4/498
6,286,157 B1 * 9/2001 Baumann ..... 4/498

* cited by examiner

*Primary Examiner*—Charles R. Eloshway
(74) *Attorney, Agent, or Firm*—Pitney, Hardin, Kipp & Szuch LLP

(57) ABSTRACT

An inflatable swimming pool assembly includes an inflatable swimming pool with a surrounding wall which confines an accommodation space and which terminates at an upper surrounding edge portion to define an opening. A flexible cover has an upper major wall to rest on the upper surrounding edge portion to cover the opening, and a flap portion to be pulled over to be disposed beyond, and outwardly and downwardly of the upper surrounding edge portion when the flexible cover is stretched. A flexible sheet member has a peripheral edge portion which is in sealing attachment to the upper major wall to confine an inflatable space therebetween to be inflated to stretch the flexible cover. An inflating valve is disposed to inflate or deflate the inflatable space.

5 Claims, 3 Drawing Sheets

INFLATABLE SWIMMING POOL ASSEMBLY

BACKGROUND OF THE INVENTION

1. Field of the Invention

This invention relates to an inflatable swimming pool assembly, more particularly to an inflatable swimming pool assembly which has a flexible cover to cover an opening of an inflatable swimming pool.

2. Description of the Related Art

To cover an opening of a conventional inflatable swimming pool for preventing contamination of water contained therein, a plastic cloth is generally used. However, once a small child climbs on top of the cloth unattended, he may be trapped by the cloth and sink into the water.

SUMMARY OF THE INVENTION

The object of the present invention is to provide an inflatable swimming pool assembly in which an inflatable flexible cover can float on water contained in an inflatable swimming pool when inflated so as to prevent small children from sinking into the water.

According to this invention, the inflatable swimming pool assembly includes an inflatable swimming pool which has a bottom base, and a surrounding wall that extends upwardly from a periphery of the bottom base to confine an accommodation space, and that terminates at an upper surrounding edge portion to define an opening for access into the accommodation space. A flexible cover has an upper major wall with a first peripheral edge portion and of such a dimension as to permit the first peripheral edge portion to rest on the upper surrounding edge portion to cover the opening when the flexible cover is stretched, and a flap portion which extends from the first peripheral edge portion such that the flap portion is suspended from the first peripheral edge portion and is to be pulled over to be disposed beyond, and outwardly and downwardly of the upper surrounding edge portion when the flexible cover is stretched. A flexible sheet member has a second peripheral edge portion which is in sealing attachment to the upper major wall to confine an inflatable space therebetween. As such, when the inflatable space is inflated, the flexible cover is stretched. An inflating valve is disposed to inflate or deflate the inflatable space.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
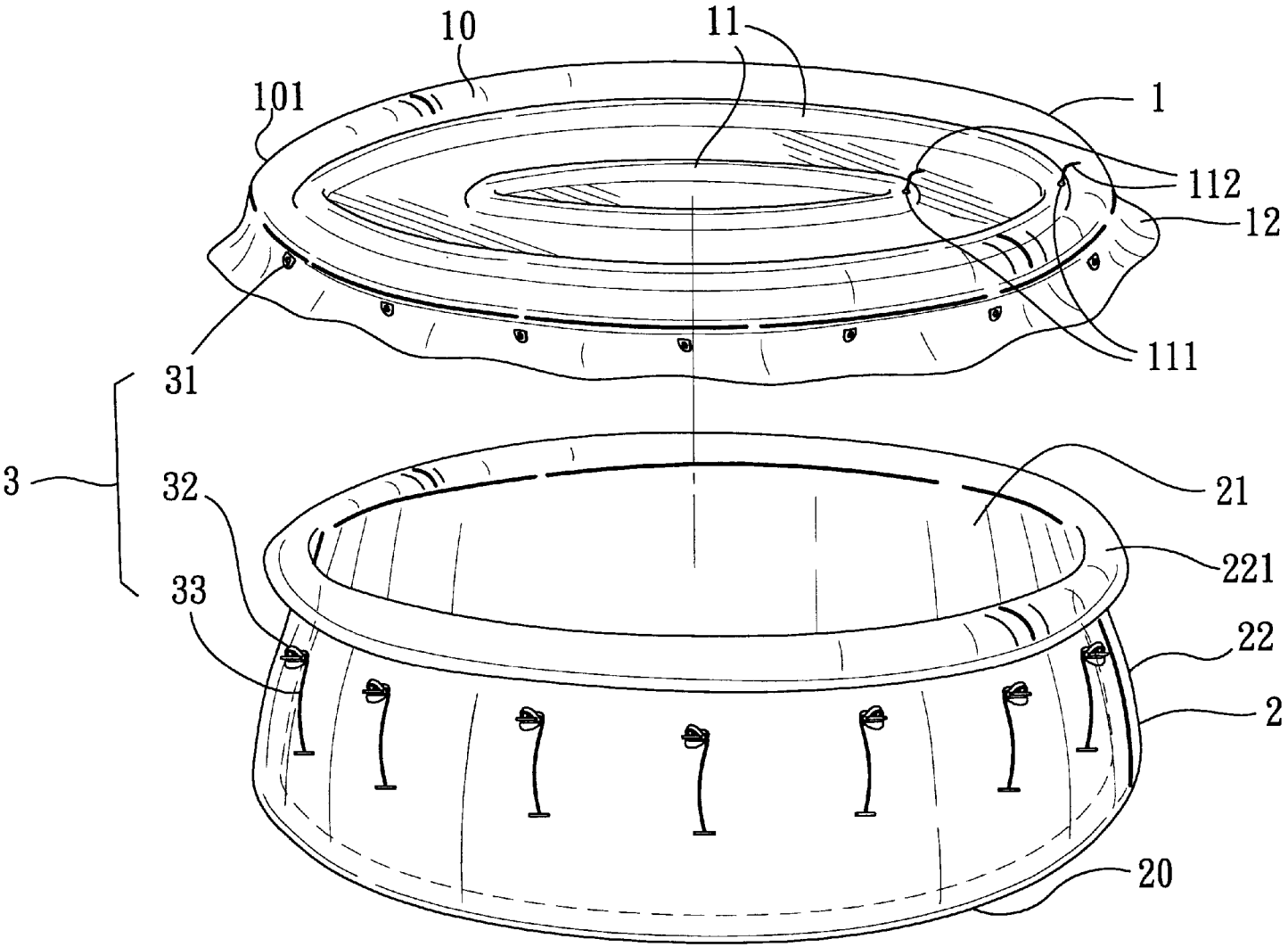
FIG. 1 is an exploded perspective view of a preferred embodiment of an inflatable swimming pool assembly according to this invention.
Figure 2:
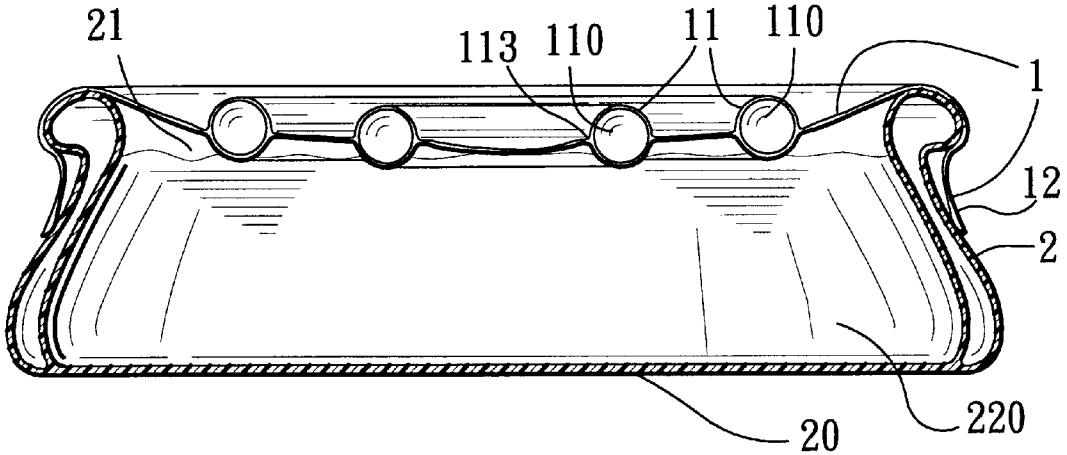
FIG. 2 is a cross-sectional view of the preferred embodiment.

Referring to FIGS. 1 and 2, the preferred embodiment of the inflatable swimming pool assembly according to the present invention is shown to comprise an inflatable swimming pool 2, a flexible cover 1, and a plurality of tightening members 3.

The inflatable swimming pool 2 has a bottom base 20, and a surrounding wall 22 which extends upwardly from a periphery of the bottom base 20 to confine an accommodation space 220, and which terminates at an upper surrounding edge portion 221 that defines an opening 21 for access into the accommodation space 220. The flexible cover 1 is made of a waterproof material, and includes an upper major wall 10 with a first peripheral edge portion 101 and of such a dimension as to permit the first peripheral edge portion 101 to rest on the upper surrounding edge portion 221 to cover the opening 21 when the flexible cover 1 is stretched, and a flap portion 12 which extends from the first peripheral edge portion 101. The flap portion 12 is suspended from the first peripheral edge portion 101 and can be pulled over to be disposed beyond, and outwardly and downwardly of the upper surrounding edge portion 221 when the flexible cover 1 is stretched. A plurality of annular flexible sheet members 11 are disposed on the upper major wall 10 of the flexible cover 1, and are arranged concentrically with the first peripheral edge portion 101. Each flexible sheet member 11 has a second peripheral edge portion 113 which is in sealing attachment to the upper major wall 10 to confine an inflatable space 110 therebetween. Thus, when the inflatable spaces 110 are inflated, the flexible cover 1 is stretched. An inflating valve 111, such as a check valve, is disposed in an outlet of each inflatable space 110 to connect with an inflating tube 112 so as to inflate or deflate the inflatable space 110.

Figure 3:
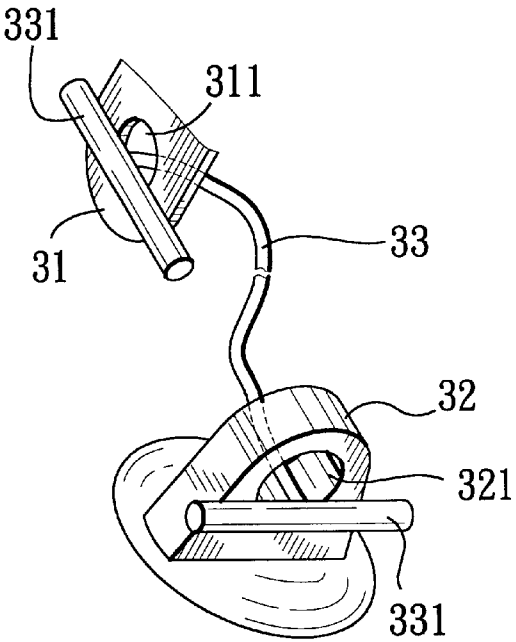
FIG. 3 is a perspective view of a tightening member of the preferred embodiment.

The tightening members 3 are disposed between the surrounding wall 22 of the inflatable swimming pool 2 and the flap portion 12 of the flexible cover 1, and are spaced apart from one another perimetrically along the upper surrounding edge portion 221 and the first peripheral edge portion 101. With reference to FIG. 3, each tightening member 3 includes a first loop member 32 which is fixed on the surrounding wall 22 and which has a hole 321 formed therethrough, a second loop member 31 which is fixed on the flap portion 12 and which has an eyelet 311 formed therethrough, a tightening cord 33 with two ends which are provided with two stop rods 331 and which are disposed to pass through the hole 321 and the eyelet 311 respectively to bring the first loop member 32 towards the second loop member 31 so as to retain the ends of the tightening cord 33 onto the first and second loop members 32,31 to secure the first peripheral edge portion 101 to the upper surrounding edge portion 221, thereby tightly covering the opening 21. As such, once a small child climbs on top of the cover 1 unattended, he will not sink into the water contained in the swimming pool 2 due to the buoyancy of the cover 1.

Figure 4:
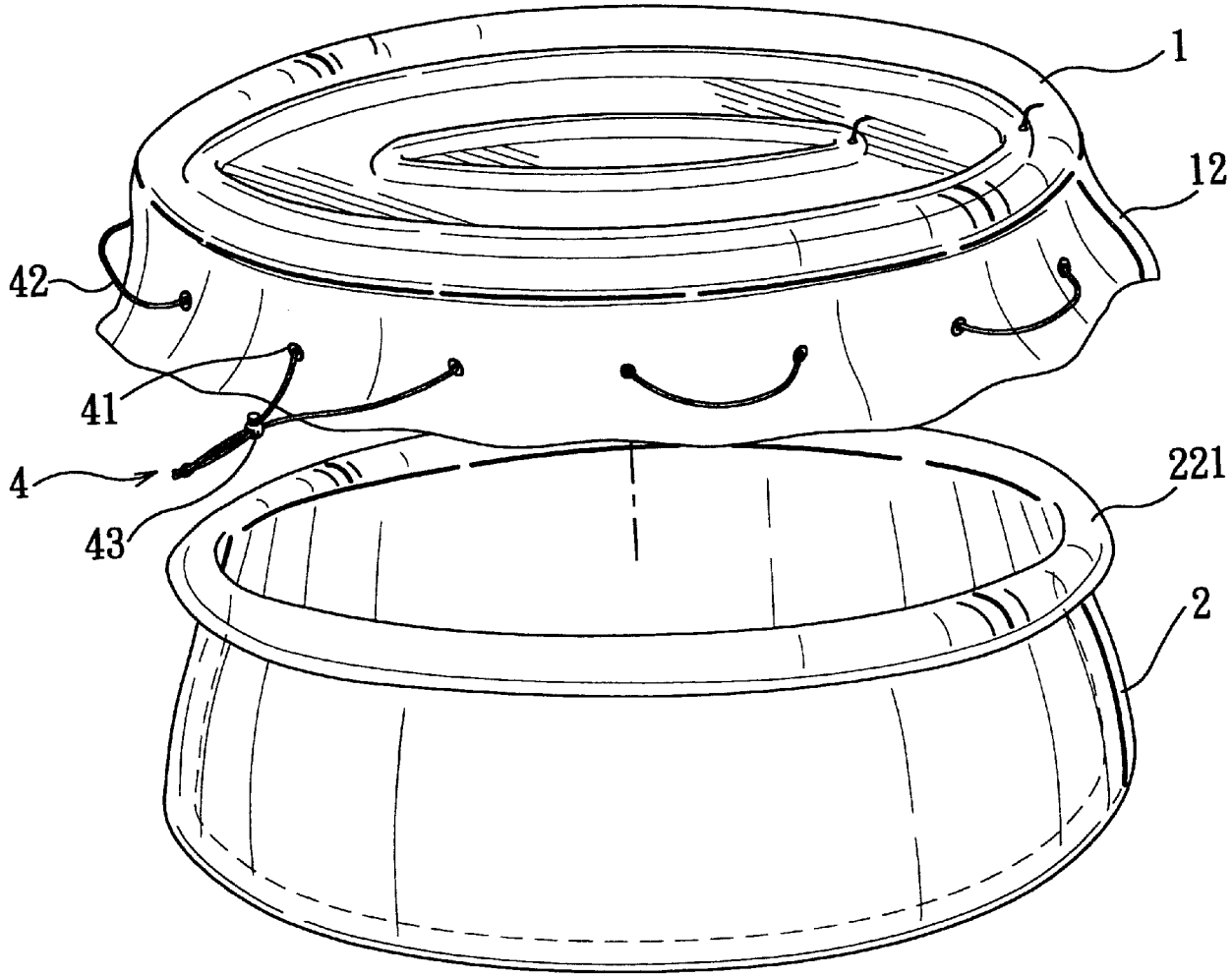
FIG. 4 is an exploded perspective view of another preferred embodiment of the inflatable swimming pool assembly according to this invention.

As shown in FIG. 4, another preferred embodiment of the inflatable swimming pool assembly according to this invention is shown to be similar to the previous embodiment in construction, except that the tightening member 4 includes a plurality of eyelets 41 which are formed in the lap portion 12 of the flexible cover 1 and which are spaced apart from one another perimetrically, a tightening cord 42 which is disposed to pass through the eyelets 41 successively so as to tighten the flap portion 12 against the upper surrounding edge portion 221 of the swimming pool 2, and a sleeve member 43 which clamps two ends of the tightening cord 42 in position.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. An inflatable swimming pool assembly comprising:

an inflatable swimming pool having a bottom base, and a surrounding wall extending upwardly from a periphery of said bottom base to confine an accommodation space, and terminating at an upper surrounding edge portion which defines an opening for access into said accommodation space;

a flexible cover having an upper major wall with a first peripheral edge portion and of such a dimension as to permit said first peripheral edge portion to rest on said upper surrounding edge portion to cover said opening when said flexible cover is stretched, and a flap portion extending from said first peripheral edge portion such that said flap portion is suspended from said first peripheral edge portion and is to be pulled over to be disposed beyond, and outwardly and downwardly of said upper surrounding edge portion when said flexible cover is stretched;

inner and outer annular flexible sheet members respectively having second and third peripheral edge portions which are inner and outer annular flexible sheet members, said inner annular flexible sheet member having second peripheral edge portions, said outer annular flexible sheet member having third peripheral edge portions, said second and third peripheral edge portions being in sealing attachment to said upper major wall to confine respectively first and second annular inflatable spaces such that when said first and second annular inflatable spaces are inflated, said flexible cover is stretched, said second and third peripheral edge portions being disposed concentrically with each other; and first and second inflating valves disposed respectively to inflate or deflate said first and second annular inflatable spaces.

2. The inflatable swimming pool assembly of claim 1, further comprising at least one tightening member disposed between said surrounding wall and said flap portion to secure said first peripheral edge portion to said upper surrounding edge portion so as to tightly cover said opening when said flexible cover is stretched.

3. The inflatable swimming pool assembly of claim 2, wherein said tightening member includes:

a loop member disposed on said surrounding wall;

an eyelet disposed in said flap portion; and a tightening cord having two ends disposed to pass through said loop member and said eyelet respectively to bring said loop member towards said eyelet so as to tightly cover said opening.

4. The inflatable swimming pool assembly of claim 3, wherein said tightening member further includes two stop rods respectively connected to said ends of said tightening cord to retain said ends of said tightening cord onto said loop member and said eyelet, respectively.

5. An inflatable flexible cover adapted to be used with an inflatable swimming pool which has a bottom base, and a surrounding wall extending upwardly from a periphery of the bottom base to confine an accommodation space, and terminating at an upper surrounding edge portion that defines an opening for access into the accommodation space, said inflatable flexible cover comprising:

an upper major wall with a first peripheral edge portion and of such a dimension as to permit said first peripheral edge portion to be adapted to rest on the upper surrounding edge portion and cover the opening when said flexible cover is stretched;

a flap portion extending from said first peripheral edge portion such that said flap portion is suspended from said first peripheral edge portion and is adapted to be pulled over to be disposed beyond, and outwardly and downwardly of the upper surrounding edge portion when said flexible cover is stretched;

inner and outer annular flexible sheet members respectively having second and third peripheral edge portions which are inner and outer annular flexible sheet members, said inner annular flexible sheet member having second peripheral edge portions, said outer annular flexible sheet member having third peripheral edge portions, said second and third peripheral edge portions being in sealing attachment to said upper major wall to confine respectively first and second annular inflatable spaces such that when said first and second annular inflatable spaces are inflated, said flexible cover is stretched, said second and third peripheral edge portions being disposed concentrically with each other; and first and second inflating valves disposed respectively to inflate or deflate said first and second annular inflatable spaces.

* * * * *